US009765452B2

(12) United States Patent
Meyer et al.

(10) Patent No.: US 9,765,452 B2
(45) Date of Patent: Sep. 19, 2017

(54) TOP COMB FASTENING FOR A TEXTILE COMBING MACHINE

(71) Applicant: Maschinenfabrik Rieter AG, Winterthur (CH)

(72) Inventors: Nikolaus Meyer, Winterthur (CH); Flavio Cavadini, Winterthur (CH)

(73) Assignee: Maschinenfabrik Rieter AG, Winterthur (CH)

( * ) Notice: Subject to any disclaimer, the term of this patent is extended or adjusted under 35 U.S.C. 154(b) by 196 days.

(21) Appl. No.: 14/431,942

(22) PCT Filed: Sep. 16, 2013

(86) PCT No.: PCT/IB2013/002056
§ 371 (c)(1),
(2) Date: Mar. 27, 2015

(87) PCT Pub. No.: WO2014/049411
PCT Pub. Date: Apr. 3, 2014

(65) Prior Publication Data

US 2015/0252495 A1 Sep. 10, 2015

(30) Foreign Application Priority Data

Sep. 28, 2012 (CH) ..... 1750/12

(51) Int. Cl.
*D01G 19/10* (2006.01)

(52) U.S. Cl.
CPC ..... *D01G 19/10* (2013.01)

(58) Field of Classification Search
CPC ..... D01G 19/10
See application file for complete search history.

(56) References Cited

U.S. PATENT DOCUMENTS 113,825 A * 4/1871 Weiler ..... D01H 5/14 19/129 R
2,404,755 A * 7/1946 Smith ..... D01H 5/14 156/92

(Continued)

FOREIGN PATENT DOCUMENTS

DE 11 20 330 12/1961
DE 102 52 098 A1 5/2004

(Continued)

OTHER PUBLICATIONS

PCT Search Report, Feb. 12, 2014.

*Primary Examiner* — Shaun R Hurley
(74) *Attorney, Agent, or Firm* — Dority & Manning, P.A.

(57) ABSTRACT

A top comb for a combing machine, comprising a top comb carrier which has a retaining section that is connected to a carrier plate to which a needle strip or a top comb clothing is fastened, the top comb carrier in the area of its retaining section being fixable to a top comb retainer by means of at least one retaining bracket that is associated with the top comb retainer. In order to minimize the wear between the top comb carrier and a retaining bracket that is hinged to a top comb retainer, it is proposed that at least two additional retaining elements are mounted on the retaining section of the top comb and can be encompassed by one retaining bracket in each case, the retaining means, at least in the area that can be encompassed by the respective retaining bracket, being made of a material that is harder than the retaining section.

9 Claims, 2 Drawing Sheets

(56) References Cited

U.S. PATENT DOCUMENTS

| | | | | | |
|---|---|---|---|---|---|
| 3,601,861 | A * | 8/1971 | Moriwaki | D01H 5/14 | 19/129 R |
| 3,688,347 | A * | 9/1972 | Nakagawa | D01G 19/10 | 19/221 |
| 4,970,851 | A | 11/1990 | Eichenberger et al. | | |
| 5,054,167 | A * | 10/1991 | Egerer | D01G 9/06 | 19/114 |
| 5,894,637 | A * | 4/1999 | Graf | D01G 19/10 | 19/115 R |
| 2009/0265892 | A1 * | 10/2009 | Mueller | D01G 15/34 | 19/113 |

FOREIGN PATENT DOCUMENTS

| | | |
|---|---|---|
| EP | 2 085 505 A2 | 8/2009 |
| FR | 2 433 598 | 3/1980 |

* cited by examiner

TOP COMB FASTENING FOR A TEXTILE COMBING MACHINE

FIELD OF THE INVENTION

The invention relates to a top comb for a combing machine, including a top comb carrier that has a retaining section connected to a carrier plate to which a needle strip or a top comb clothing is fastened. The top comb carrier in the area of its retaining section is fixable to a top comb retainer by means of at least one retaining bracket that is associated with the top comb retainer.

BACKGROUND

The top comb of a combing machine is subjected to changing dynamic loads during the combing process, which become evident to some extent in an elastic deformation of the top comb, in particular in its longitudinal direction. This in turn acts on the fastening points of the top comb in the combing machine. That is, the elastic deflection of the top comb which occurs transversely with respect to the longitudinal direction of the top comb results in relative motions between the fixedly supported retaining elements (retaining brackets, for example) and the retaining section of the top comb. As a result, the retaining section in this area is subjected to wear. Eight top combs are customarily used on a combing machine, corresponding to the number of comb heads.

To minimize the elastic deflection of the top comb during operation, it has been proposed in EP 2085505 B1 to reinforce the top comb in the area of its carrier plate with additional stiffening means. Although it was thus possible to decrease the elastic deflection, the wear in the area of the respective retaining bracket and the retaining section of the top comb could not be completely prevented. For dynamic reasons, the top comb carrier is made of a material having a lower specific gravity than steel, and is produced, for example, in an aluminum die casting or casting process. The retaining brackets must exert an appropriate spring action in order to securely hold the top comb in its installed position in the top comb retainer. Therefore, the retaining brackets are made of a spring steel, which has a higher surface hardness than the retaining section of the top comb carrier. As a result, the wear occurs essentially in the area of the softer material of the top comb retainer. This means that the entire top comb retainer sometimes must be replaced even after a short service time in order to keep the desired optimal comb conditions constant.

To reduce the wear, it was therefore proposed in DE 102 52 098 A1 to install a wear protector between the top comb and the top comb retainer. In particular, it was proposed to provide a coating made of plastic in the area of the retaining section of the top comb or on the respective retaining bracket.

Although it was thus possible to reduce the wear in this area, the installation of such a coating is complicated and entails additional costs. Furthermore, there is the risk that the coating may likewise become worn due to the dynamic loads in the area of this fastening point, even after a short time, requiring it to be replaced.

SUMMARY OF THE INVENTION

An object of the invention is to propose a top comb which, with respect to the described disadvantages of known approaches, has significantly less wear in the area where it is fixed to the top comb retainer. Additional objects and advantages of the invention will be set forth in part in the following description, or may be obvious from the description, or may be learned through practice of the invention.

For achieving the objects, it is proposed that at least two additional retaining elements are mounted on the retaining section of the top comb and can be encompassed by one retaining bracket in each case. The retaining elements, at least in the area that can be encompassed by the respective retaining bracket, are made of a material that is harder than the retaining section. This may be achieved, for example, in that the additional proposed retaining elements between the top comb retainer or the retaining brackets and the top comb carrier is made of a material having a higher specific gravity than the material of the retaining section of the top comb carrier.

This makes it possible that the retaining bracket (which generally is made of a hard spring steel) no longer directly comes to rest on the softer surface of the retaining section. That is, the respective retaining bracket now comes to rest on the retaining element, provided with a harder surface, which is additionally mounted on the retaining section. The abrasion and thus the wear in the area of this fixing or its fastening point for the top comb are therefore reduced. This means that the wear in the area of the fastening point is greatly minimized by the proposed material combination, and therefore the service life is increased. However, if wear should occur in the area of this additional retaining element after an extended period of use, this retaining element may merely be replaced with a new retaining element in order to once again attain the desired conditions, with the top comb being securely and fixedly held.

It is preferably proposed that a retaining element is mounted in each case on the respective end of the retaining section of the top comb, viewed in the longitudinal direction of the retaining section. This allows easy mounting of the additional retaining element on the retaining section of the top comb carrier.

Furthermore, it is proposed that the retaining elements are pins, made of a metallic material, which are detachably or nondetachably connected to the retaining section.

By the use of pins, the installation and fastening of the retaining elements may be carried out without a specific orientation with respect to the retaining section of the top comb.

When a detachable fastening is used, the pins may be quickly exchanged with replacement pins if they show wear after extended use.

The use of steel pins is preferably proposed.

To easily and quickly fasten the pins to the retaining section of the top comb, it is proposed that the pins are provided with a threaded bolt, and the retaining section has threaded holes in the area of its two ends.

This ensures rapid mounting and dismounting of the pin and the retaining elements.

It is further proposed that the material of an outer layer of the retaining elements, which directly adjoins the particular peripheral surface of the respective retaining element, is harder than the remaining material of the retaining element. The degree of hardness is expressed as Shore hardness, for example.

This may be achieved, for example, by subjecting the retaining elements to a quenching and tempering process in which the outer layer is hardened.

It is likewise possible to provide the outer layer of the retaining elements with a greater hardness, using a proposed nitriding process. Other processes may also be used to impart a greater hardness to the respective outer layer of the retaining devices.

BRIEF DESCRIPTION OF THE DRAWINGS

Further advantages of the invention are shown and described below with reference to exemplary embodiments.

The figures show the following.

DETAILED DESCRIPTION

Figure 1:
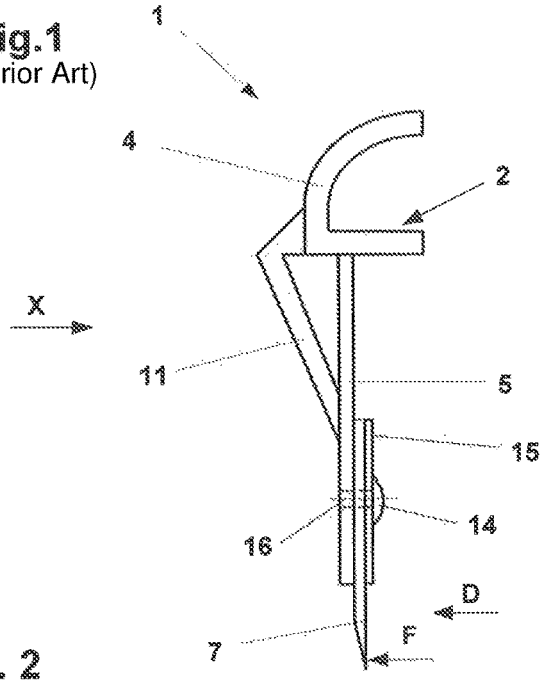
Fig.1 (Prior Art)
FIG. 1 shows a schematic side view of a known top comb carrier.

Reference will now be made to embodiments of the invention, one or more examples of which are shown in the drawings. Each embodiment is provided by way of explanation of the invention, and not as a limitation of the invention. For example features illustrated or described as part of one embodiment can be combined with another embodiment to yield still another embodiment. It is intended that the present invention include these and other modifications and variations to the embodiments described herein.

FIG. 1 shows a cross section of a known top comb carrier 2 of a top comb 1 which is used on a combing machine, not illustrated. The top comb carrier 2 is made up of a retaining section 4 to which a carrier plate 5 is fastened. The retaining section 4 has the cross-sectional shape of an open profile having an arc-shaped outer surface.

Figure 2:
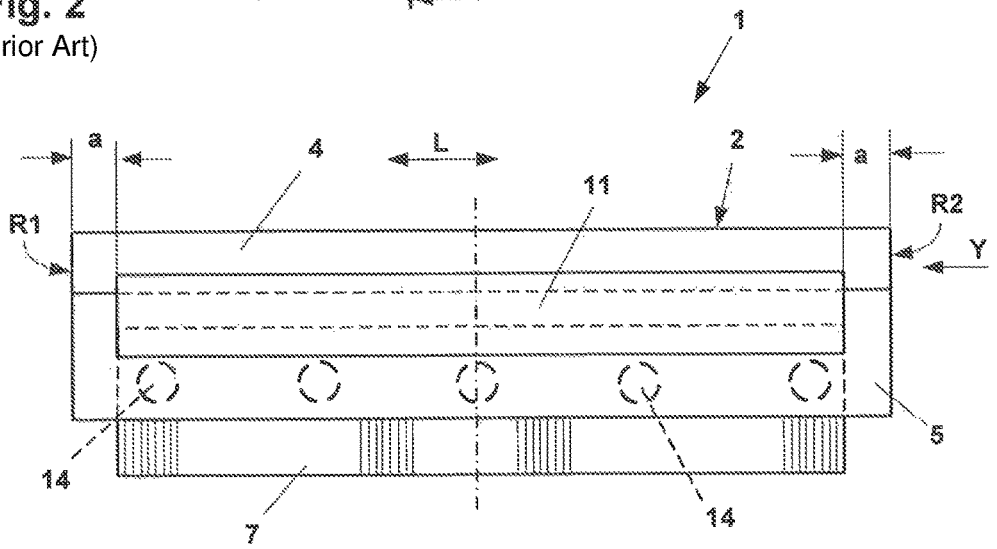
Fig. 2 (Prior Art)
FIG. 2 shows a schematic front view X of the top comb carrier according to FIG. 1 in a reduced scale.
Figure 3:
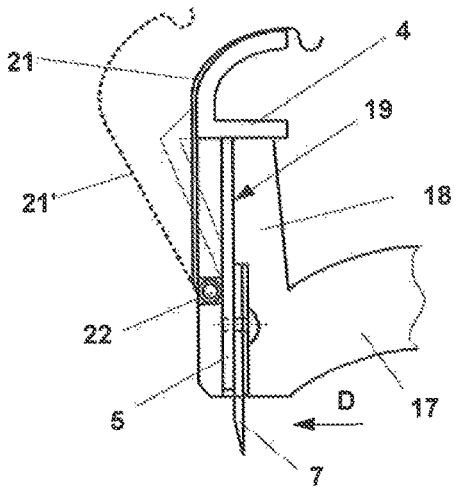
Fig. 3 (Prior Art)
FIG. 3 shows a schematic illustration of a known fastening point of the top comb carrier in a side view Y according to FIG. 2.

The retaining section 4 and the carrier plate 5 may be produced in one piece (made of plastic or an extruded aluminum alloy, for example). To increase the flexural strength of the top comb carrier 4, in particular in its longitudinal direction L, in the known design a reinforcing element 11 is fastened in the connecting area of the retaining section 2 and the carrier plate 5, and extends over almost the entire length of the top comb carrier 2, as is apparent from FIG. 2. As shown in FIG. 2, the reinforcing element 11 ends at a distance "a" from the respective outer edges R1, R2 of the top comb carrier 2. This free space in the area of the distance "a" is necessary for installing and fastening the top comb carrier 2 in top comb retainers 17, as schematically illustrated in FIG. 3.

The reinforcing element 11 is connected at one end to the retaining section 4, and at the other end to the carrier plate 5. The reinforcing element 11 together with the retaining section 4 and the carrier plate 5 form a hollow profile having a triangular cross section.

The downwardly tapering triangular cross section ensures that the reinforcing element 11 does not collide with the pressure cylinder of a subsequent pair of detaching rollers, which in the installed position of the top comb 1 is in the immediate vicinity. The geometric configuration of the detaching rollers with respect to the top comb is apparent from EP 354 456 A2, for example. This prior publication also schematically shows the manner in which the top comb retainers 17 are fastened to a top comb bed which is mounted to a lower nipper of a nipper unit.

A top comb clothing 7 is fastened in the lower area of the carrier plate 5 via a plurality of screws 14 and the clamping plate 15. Threaded holes 16 are provided in the carrier plate 15, corresponding to the number of screws 14. The clothing 7 is clamped on the carrier plate 5 via the screws 14 and the clamping plate 15.

The clothing 7 of the top comb 1 may be present as needle strips arranged in a row, as punched or embossed metal sheets arranged in a row, or in some other form.

As is generally known, during the detaching process the fibre tuft, which is combed by means of a circular comb, is subsequently pulled through the clothing 7 of the top comb 1 in the flow direction D via the detaching rollers. The force F which occurs results in a deflection of the carrier plate 5, in particular in the middle area of the top comb 1. This is an elastic deflection which swings back after the force F is discontinued. That is, for a comb cycle of 500 nips/min, for example, which is presently customary, this process takes place 500 times per minute. This elastic oscillation is transmitted in the longitudinal direction L of the top comb carrier 2 until reaching the area a of the fastenings of the top comb 1. This results a large number of periodic relative motions between the retaining section 4 and the respective fastening element via which the top comb 1 is held in position in the combing machine. FIG. 3 (view Y) shows one of the fastening elements in the form of a retaining bracket 21 which is supported on a top comb retainer 17 so as to be pivotable about an axis 22. The retaining bracket 21 at its free end is designed in such a way that that it assumes a locked position when the arc-shaped outer contour encompasses the retaining section 4. The function of this retaining bracket is also apparent from the exemplary embodiments in DE 102 52 098 A1.

The dashed-line illustration 21' in FIG. 3 shows the retaining bracket 21 in its unlocked position in which the top comb carrier 2 may be removed at the top from a slot 19 in a vertical receptacle 18 of the top comb retainer 17. For each top comb, two such top comb retainers 17 are fastened to a nipper unit, not shown. As described above, in particular the retaining section 4 in the area of its fastenings 21 is locked by the described relative motions.

Figure 4:
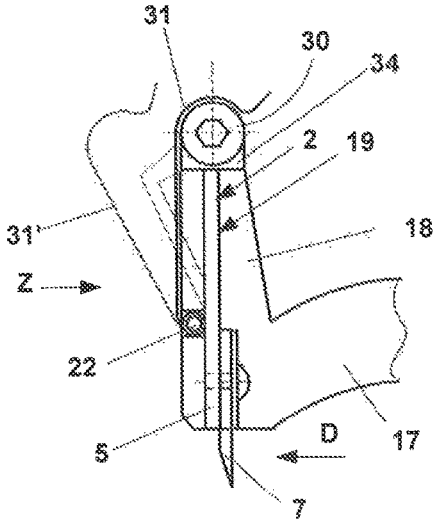
FIG. 4 shows a schematic illustration according to FIG. 3 together with the proposed retaining means according to the invention.

The illustration in FIG. 4 shows the mounting of one of the retaining elements 30 according to the invention, which in the installed position shown is partially surrounded by a retaining bracket 31. As described in the examples above, the retaining bracket 31 is supported on a top comb retainer 17 so as to be pivotable about an axis 22. In the installed position shown, the retaining elements 30, and thus the top comb carrier 2, are locked by an appropriately designed arc-shaped end of the retaining bracket 31. The dashed-line illustration 31' in FIG. 4 shows the retaining bracket 31 in its unlocked position in which the top comb carrier 2 may be removed at the top from a slot 19 in a vertical receptacle 18 of the top comb retainer 17.

Figure 5:
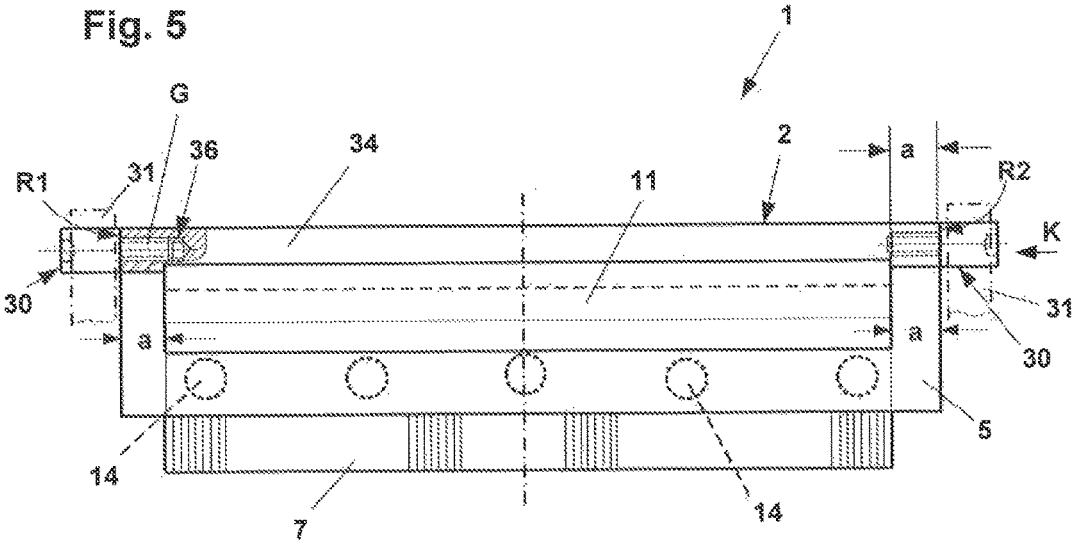
FIG. 5 shows a schematic front view Z of the top comb according to FIG. 4 in a reduced scale.

As is apparent from the reduced-scale view Z in FIG. 5, a retaining element 30 protrudes in each case beyond the outer edges R1, R2 of the retaining section 34.

Figure 7:
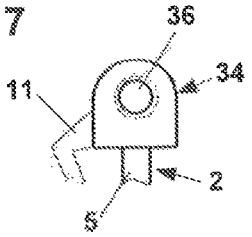
FIG. 7 shows an enlarged partial view K according to FIG. 5 without the retaining means.

It is apparent from the enlarged partial view K (according to FIG. 5) in FIG. 7 that the retaining section 34 has a closed cross section, with a threaded hole 36 which is used for accommodating a threaded bolt G of the pin-shaped retaining element 30 being present at both ends of this retaining section 34.

Figure 6:
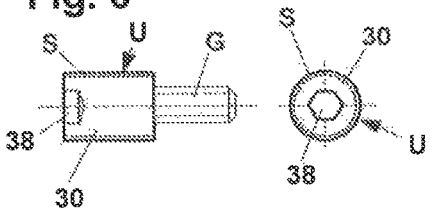
FIG. 6 shows an enlarged side view and top view of a retaining means according to FIG. 5.

In order to screw the respective retaining element 30 (also referred to as a pin) with the respective threaded bolt G into the threaded hole 36 in the area of the edges R1, R2, the pin 30 (retaining element) is provided with an indentation 38 having the shape of a screw head, as is apparent in the enlarged view in FIG. 6. In the installed position shown in FIG. 5, the pins may be fastened in the respective threaded hole 36 using an appropriately designed socket wrench which protrudes into the indentation 38. As schematically indicated, the retaining brackets 31 are mounted in the area of the pins 30.

The wear in the area of the fastening point to the retaining brackets is reduced and the service life is significantly prolonged by quenching and tempering (hardening) of the outer layer S of the pins 30 which adjoins the periphery of the pins. The layer S is schematically indicated in the views in FIG. 6. The outer boundary of the layer S forms the peripheral surface U of the pin 30.

However, if wear should occur in the area of the pins 30, the pins may be easily replaced. That is, it is no longer necessary to replace the entire comb carrier, as in the known designs.

Modifications and variations can be made to the embodiments illustrated or described herein without departing from the scope and spirit of the invention as set forth in the appended claims.

The invention claimed is:

1. A top comb for a combing machine, comprising:

a top comb carrier that has a retaining section connected to a carrier plate to which a needle strip or a top comb clothing is attached;

in the area of the retaining section, the top comb carrier is removably fixed to a top comb retainer by retaining brackets associated with a top comb retainer;

at least two retaining elements mounted on the retaining section of the top comb that are engaged by a respective one of the retaining brackets; and wherein an area of each retaining element that is engaged by the retaining bracket made of a material that is harder than the retaining section.

2. The top comb according to claim 1, wherein a respective one of the retaining elements is mounted on opposite ends of the retaining section of the top comb, viewed in a longitudinal direction of the retaining section.

3. The top comb according to claim 2, wherein the retaining elements comprise pins made of a metallic material, wherein the pins are detachably or non-detachably connected to the retaining section.

4. The top comb according to claim 3, wherein the pins are made of steel.

5. The top comb according to claim 4, wherein the pins comprise a threaded bolt, and the retaining section has threaded holes at the opposite ends thereof for receipt of the threaded bolts.

6. The top comb according to claim 4, wherein the pins comprise an outer peripheral layer of material that is harder than the remaining material of the pins.

7. The top comb according to claim 6, wherein the pins are quenched and tempered.

8. The top comb according to claim 6, wherein the pins are nitrided.

9. A combing machine, comprising:

a top comb, the top comb further comprising a top comb carrier that has a retaining section connected to a carrier plate to which a needle strip or a top comb clothing is attached;

in the area of the retaining section, the top comb carrier is removably fixed to a top comb retainer by retaining brackets associated with a top comb retainer;

at least two retaining elements mounted on the retaining section of the top comb that are engaged by a respective one of the retaining brackets; and wherein an area of each retaining element that is engaged by the retaining bracket made of a material that is harder than the retaining section.

* * * * *